United States Patent [19]

Edens

[11] Patent Number: 4,717,332

[45] Date of Patent: Jan. 5, 1988

[54] FLAME RETENTION BURNER APPARATUS AND METHOD

[76] Inventor: P. Clifton Edens, 12 Lakeview Estates, Winfield, Kans. 67156

[21] Appl. No.: 800,674

[22] Filed: Nov. 22, 1985

[51] Int. Cl.[4] ..... F23D 14/46; F23C 1/00

[52] U.S. Cl. ..... 431/8; 431/350; 431/285; 431/187

[58] Field of Search ..... 431/171, 181, 182, 183, 431/187, 278, 284, 285, 264, 265, 8

[56] References Cited

U.S. PATENT DOCUMENTS

| | | | |
|---|---|---|---|
| 3,074,469 | 1/1963 | Babbitt et al. | 431/285 |
| 3,180,395 | 4/1965 | Reed | 431/285 |
| 4,311,449 | 1/1982 | Young | 431/284 |
| 4,389,188 | 6/1983 | Kamath | 431/284 |
| 4,484,887 | 11/1984 | Pettersson | 431/265 |

FOREIGN PATENT DOCUMENTS

| | | | |
|---|---|---|---|
| 2809114 | 9/1979 | Fed. Rep. of Germany | 431/284 |

*Primary Examiner*—Margaret A. Focarino
*Attorney, Agent, or Firm*—Phillip A. Rein

[57] ABSTRACT

This invention relates to a flame retention burner apparatus and method of using same which can be mounted in various heat exchange apparatus and operable to efficiently and effectively achieve the diffusion and atomization of air and fuel particles for a high efficiency burning process. The flame retention burner apparatus includes a combustion head assembly having a (1) a main combustion chamber housing; (2) an inlet fuel and air diffuser assembly to initially cause agitation of fuel and air being admitted thereto; (3) a retention plate and cylinder assembly mounted within the inlet fuel and air diffuser assembly to achieve further agitation of the air particles; and (4) an air and fuel diffuser assembly operable to diffuse the inlet air particles in a new and novel manner and also to inject a liquid fuel when in that particular fuel type usage mode. The combination of the inlet fuel and air diffuser assembly, the retention plate and the cylinder assembly, and the air and fuel diffuser assembly operates to provide a new and novel movement of the air and fuel particles therein to achieve a highly efficient and effective burning process. The flame retention burner apparatus is readily used with multiple fuels and easily switched from a gaseous to a liquid fuel usage. The method of supplying the inlet air and fuel achieves a new and novel process of this invention.

14 Claims, 10 Drawing Figures

FIG. 6
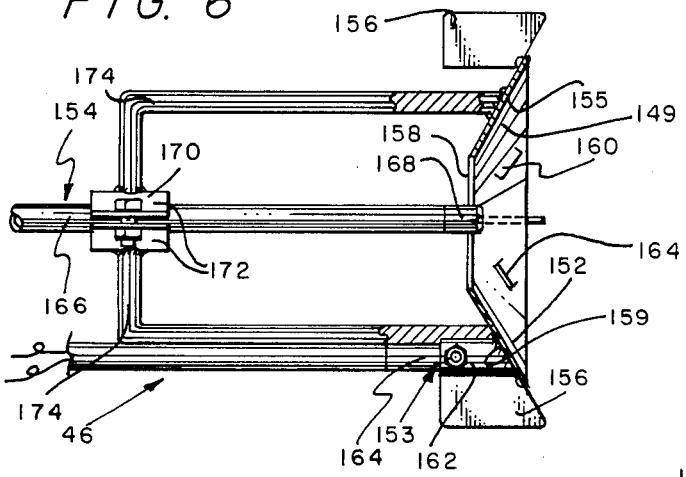
FIG. 7
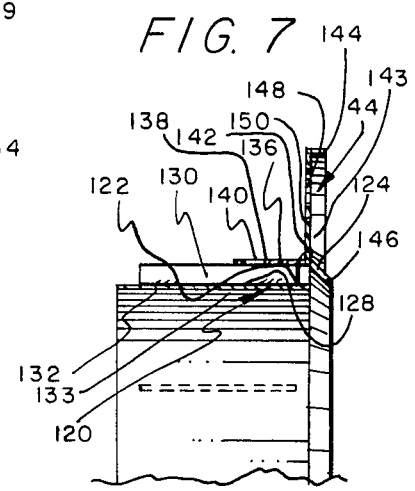
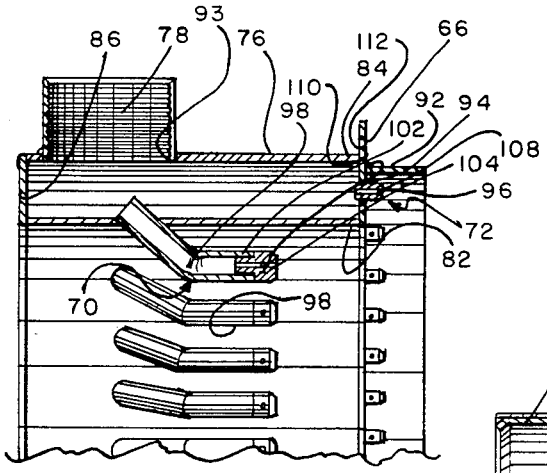
FIG. 8
FIG. 9
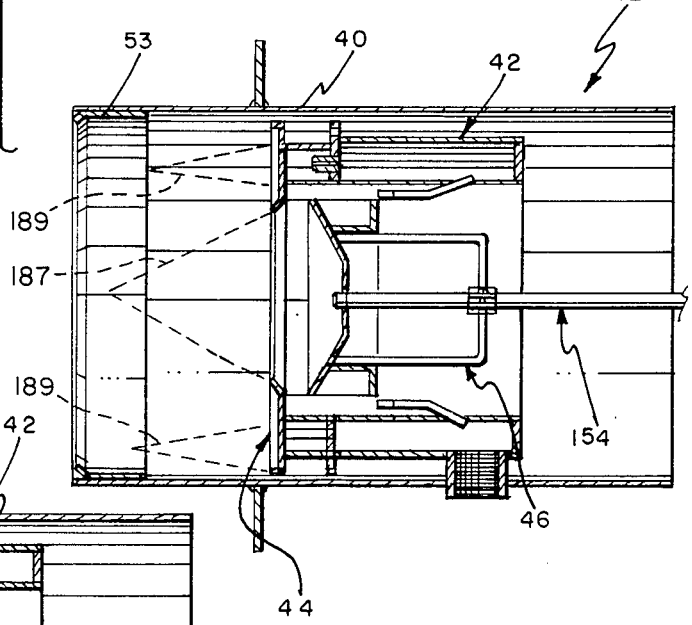
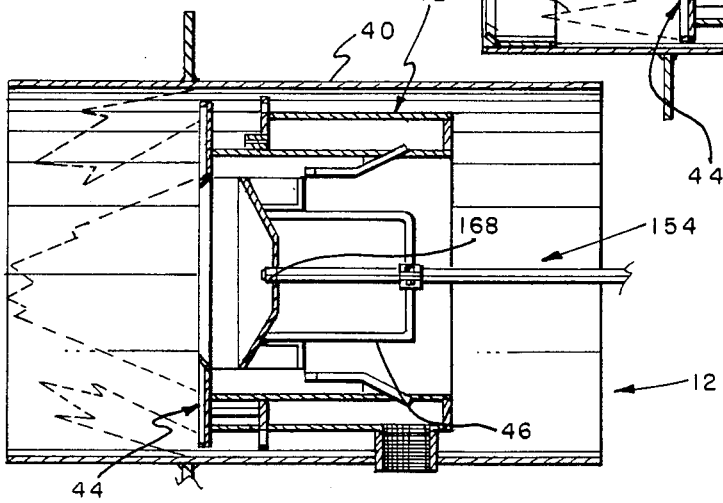
FIG. 10

FLAME RETENTION BURNER APPARATUS AND METHOD

PRIOR ART

A patentablility investigation was not conducted on this invention as the applicant herein is knowledgeable and highly skilled in the area of oil and gas fired burner apparatuses used in applications from small to very large boiler and heater systems, It has been the practice in the prior art to assemble and manufacture a combustion head assembly which is normally applicable for the burning of a liquid fuel such as oil or a gaseous fuel such as natural gas, propane, or the like. In the past few years, it has become necessary for boiler structures in the industry to be able to be operable on either a liquid or a gaseous fuel whenever shortages of either product becomes accute. Many of the large industrial users of energy are being required to cease use of their fuel supply during times of acute shortages such as extreme winter conditions, oil embargoes, or the like. Therefore, this invention presents a new and novel, highly efficient, flame retention burner apparatus which can be used with multi-fuels thereby presenting the state of art in combustion head assemblies.

PREFERRED EMBODIMENT OF THE INVENTION

In one preferred embodiment, the invention relates to a heat exchange apparatus and method having a new and novel flame retention burner apparatus of this invention mounted therein. The heat exchange apparatus can be of a boiler type structure having (1) an inlet air assembly to direct a combustion air flow utilizing the adjacent atmospheric air; (2) a fuel control assembly mounted on the inlet air assembly in order to direct the flow of multi-type fuels to mix with the inlet combustion air; (3) the flame retention burner apparatus 12 to receive the subject combustion air and fuel, respectively, from the inlet air assembly and the fuel control assembly; and (4) the heat exchange apparatus having a heat transfer assembly operable to receive the heat and gaseous material generated after combustion within the flame retention burner apparatus. The inlet air assembly and the fuel control assembly operate in the substantially conventional manner to provide the necessary volume and quantity of inlet air and fuel, such as gas or oil, into the flame retention burner apparatus. The flame retention burner apparatus includes a combustion head assembly having (1) a main combustion chamber housing; (2) an inlet fuel and air diffuser assembly mounted within the main combustion chamber housing; (3) a retention plate and cylinder assembly to aid in the proper direction of air and fuel for mixture thereof; and (4) an air and fuel diffuser assembly operable to achieve the new and novel mixing and efficient combustion of air and fuel therewithin. The inlet fuel and air diffuser assembly includes two sets of spaced fuel nozzle members, each in a circular pattern, to achieve the efficient and effective diffusion of the gaseous particles. The retention plate and cylinder assembly includes fuel and air director cylinders therein to achieve the mixing of the air and fuel particle before the mixture is subsequently ignited so as to achieve full and complete ignition thereof. The air and fuel diffuser assembly is provided with means for supplying and diffusing oil particles to achieve a complete efficient atomization thereof for efficient oil fuel economy. The heat exchange apparatus is operable to ahieve the warming of air, water, or the like in a conventional heat transfer situation. The method of this invention involves the steps of entering the air and fuel particles for complete diffusion and atomization.

OBJECTS OF THE INVENTION

One object is to provide a heat exchange apparatus having a new and novel flame retention burner apparatus of this invention mounted therein operable to be efficiently and effectively utilized with multi-fuels such as gas and oil whereupon the heat exchange apparatus can be immediately transferred from using one fuel to the other and be highly efficient in either of such uses.

Still, one other object of this invention is to provide a flame retention burner apparatus having a combustion head assembly operable with multi-fuels being highly efficient in the mixing of the air and fuel particles in a new method to achieve a complete burning of the fuel particles in the proper air to fuel ratio for maximum heat generation efficiency.

One other object of this invention is to provide a flame retention burner apparatus which can be readily installed on an existing heat exchange apparatus such as hot water boilers or the like without requiring extensive alteration thereof.

One further object of this invention is to provide a flame retention burner apparatus having an efficient combustion head assembly provided with an inlet fuel and air diffuser assembly and an air and fuel combustion diffuser assembly to achieve the efficient and effective mixing of the air and fuel particles prior to ignition so as to provide 100% burning of the fuel particles therein and an efficient air to fuel ratio.

Still, one other object of this invention is to provide a flame retention burner apparatus which is efficient in operation; substantially maintenance free; operable for multi-fuel usage; compact in structure; and transferable from one fuel usage to another with a minimum amount of effort and time.

Various other objects, advantages, and features of the invention, will become apparent to the those skilled in the art from the following discussion, taken in conjunction with the accompanying drawings, in which:

FIGURES OF THE INVENTION

FIG. 6 is an enlarged sectional view of an air and fuel diffuser assembly of the flame retention burner apparatus of this invention;

FIG. 7 is an enlarged fragmentary sectional view taken along line 7–7 in FIG. 4 of a support and air diffuser assembly of the flame retention burner apparatus of this invention;

FIG. 8 is an enlarged fragmentary sectional view taken along line 8—8 in FIG. 4 of an inlet fuel and air diffuser assembly of the flame retention burner apparatus of this invention;

FIG. 9 is a sectional schematic diagram showing the flame retention burner apparatus of this invention utilizing a gaseous fuel; and FIG. 10 is a sectional schematic diagram similar to FIG. 9 with the flame retention burner apparatus of this invention utilizing a liquid fuel.

Figure 2:
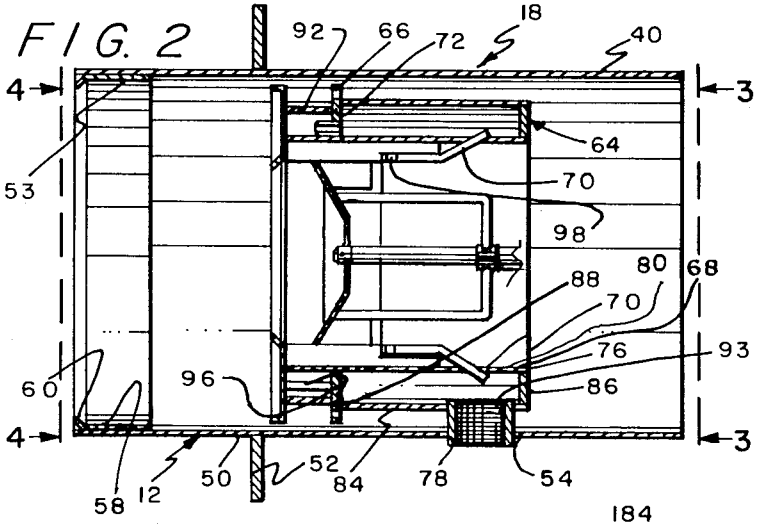
FIG. 2 is a longitudinal sectional view of the flame retention burner apparatus of this invention.

The following is a discussion and description of preferred specific embodiments of the new flame retention burner apparatus of this invention, such being made with reference to the drawings, whereupon the same reference numerals are used to indicate the same or similar parts and/or structure. It is to be understood that such discussion and description is not to unduly limit the scope of the invention.

DESCRIPTION OF THE INVENTION

Figure 1:
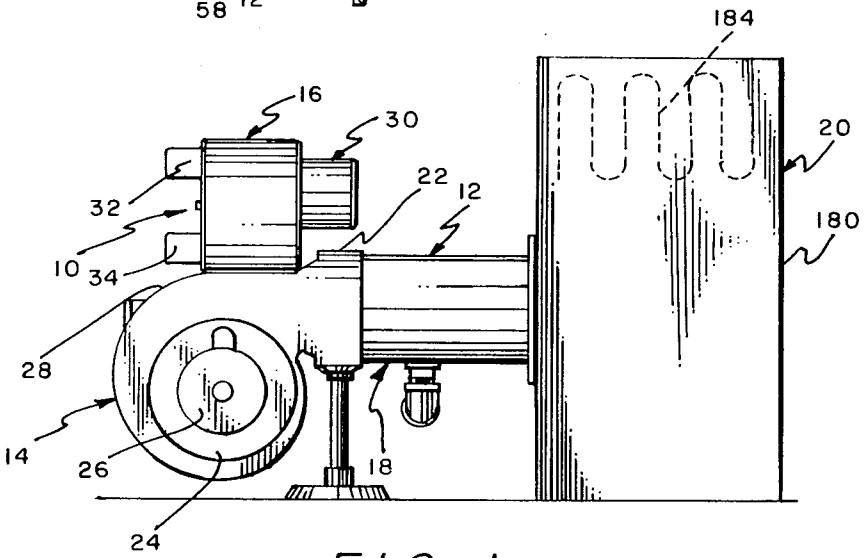
FIG. 1 is a side elevational view of a heat exchange apparatus having a flame retention burner apparatus of this invention connected thereto.
Figure 4:
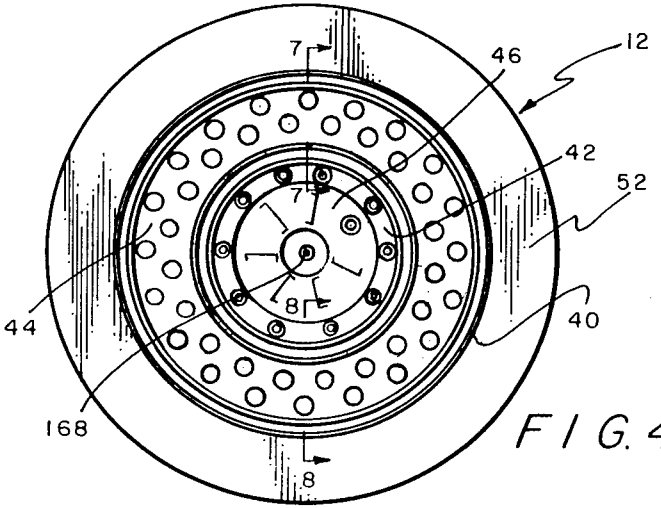
FIG. 4 is a view similar to FIG. 3 taken along line 4—4 in FIG. 2.
Figure 3:
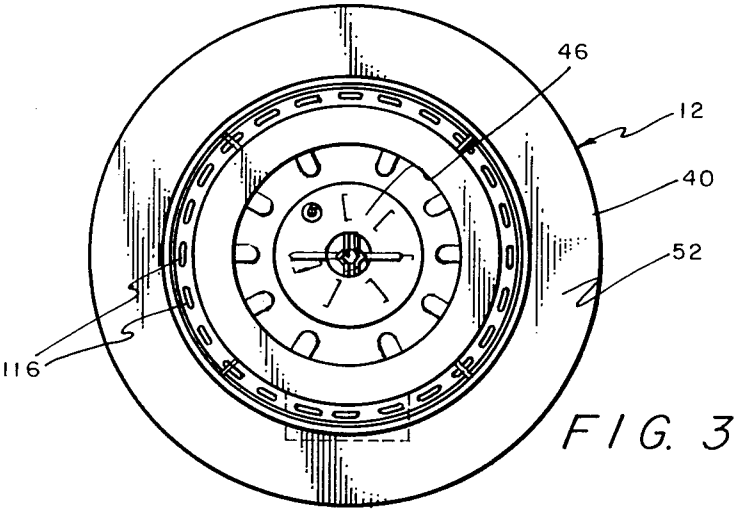
FIG. 3 is a view taken along line 3'3 in FIG. 2 illustrating one end view of the flame retention burner apparatus of this invention.

On referring to the drawings in detail and, in particular to FIG. 1, a heat exchange apparatus 10 is illustrated with a flame retention burner apparatus 12 of this invention connected thereto. The heat exchange apparatus 10 can be utilized in a system such as air or water boilers for heat transfer and normally found in industrial applications.

The heat exchange apparatus 10 includes (1) an inlet air assembly 14 to provide combustion air; (2) a fuel control assembly 16 operable to receive multi-fuels therein and selectively control the flow and burning thereof; (3) the flame retention burner apparatus 12 which is adapted to receive the air and fuel necessary for combustion from the inlet air assembly 14 an the fuel control assembly 16; and (4) a heat exchange assembly 20 adapted to transfer the heat generated from the combustion in the flame retention burner apparatus 12 into an air or water heat transfer system.

The inlet air assembly 14 includes (1) a squirrel cage type fan housing 22; (2) a blower fan member 24 mounted within the fan housing 22; and (3) a blower motor 26 connected to the blower fan member 24 to rotate same in a conventional manner. The blower fan member 24 includes a squirrel cage member 28 which is driven by the blower motor 26 which can be of an electrical variable speed type as required.

The fuel control assembly 16 includes a fuel flow and ignition control assembly 30 operable to receive multi-fuels such as natural gas and fuel oil so that either can be used in the flame retention burner apparatus 12 of this invention and conversion from use of one fuel to another can be achieved in a rapid manner. The fuel flow and ignition control assembly 30 includes (1) an oil flow assembly 32 to control the flow of a liquid energy source such as fuel oil therethrough; and (2) a gas flow assembly 34 to receive, control, and monitor the flow of a gaseous energy source such as natural gas or propane into the flame retention burner apparatus 12 of this invention.

Figure 5:
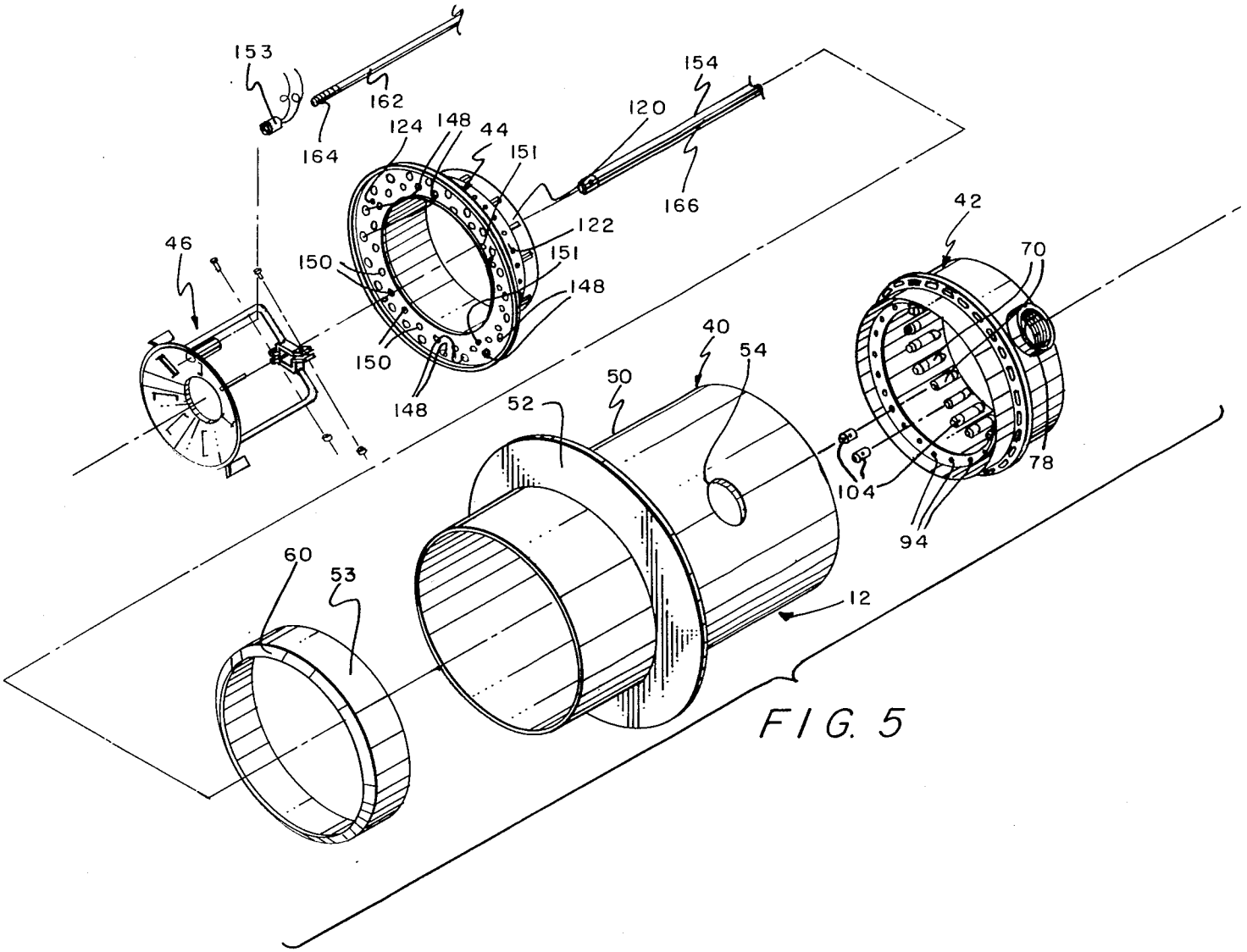
FIG. 5 is an exploded perspective view of the flame retention burner apparatus of this invention.

As noted in FIG. 5, the flame retention burner apparatus 12 includes the combustion head assembly 18 having (1) a main combustion chamber housing 40; (2) an inlet fuel and air diffuser assembly 42 mounted within the main combustion chamber housing 40; (3) a retention plate and cylinder assembly 44 which is mounted within the inlet fuel and air diffuser assembly 42; and (4) an air fuel diffuser assembly 46 mounted within the retention plate and cylinder assembly 44.

The main combustion chamber housing 40 includes a cylindrical housing member 50; an anchor and support ring or flange 52 mounted about an outer periphry of the cylindrical housing member 50; and (3) a choke and nozzle assembly 53 mounted within an outer end of the cylindrical housing member 50. The cylindrical housing member 50 is constructed of a substantially rigid plate material as it serves as an internal combustion chamber and has an inlet pipe opening 54 operable to permit the entrance of gaseous material to the interior portion thereof as will be explained.

The anchor and support ring or flange 52 is of a heavy plate material and operates to be usable as a support flange but provides rigidity and support to the cylindrical housing member 50 so as to keep the same from becoming oblong or warped during the heating process which will be explained. The choke and nozzle member 53 includes a ring member 58 which is releasably attached to an outer end of the discharge end of the cylindrical housing member 50 and used only for a gaseous fuel-air mixture for combustion. An outer end of the ring member 58 is formed within an internal tapered peripheral flange portion 60 which operates as a choke and throttle to direct air inwardly and achieve the effective and efficient combustion air-gaseous fuel mixture.

As noted in FIG. 2, the inlet fuel and air diffuser assembly 42 includes (1) an inlet fuel diffuser assembly 64; and (2) an outer support and air diffuser assembly 66 mounted about the inlet fuel diffuser assembly 64 and between the interior surface of the cylindrical housing member 50.

The inlet fuel diffuser assembly 64 includes (1) a main fuel chamber 68; (2) an inner fuel nozzle assembly 70 connected to an inner surface of the main fuel chamber 68; and (3) an outer fuel nozzle assembly 72 mounted on a forward wall portion of the main fuel chamber 68. The main fuel chamber 68 includes a fuel sleeve member 76 having in inlet pipe member 78 connected thereto and extended outwardly therefrom.

The fuel sleeve member 76 resembles a doughnut shaped structure but having a cross section of generally rectangular shape. More specifically, the fuel sleeve member 76 includes (1) an inner cylindrical wall 82; (2) an outer cylindrical wall 84; (3) a solid inlet end wall 86 interconnecting adjacent ends of the cylinder walls 82, 84; and (4) a discharge end wall 88 interconnecting the other opposite adjacent ends of the cylinder walls 82, 84. The outer cylinder wall 84 is provided with a forwardly projecting wall section 92 and having a fuel inlet opening 93 therein. The fuel inlet pipe member 78 is mounted within the fuel inlet opening 93 and extended through the inlet pipe opening 54 in the cylindrical housing member 50 so as to direct and contain the flow of gaseous fuel into the interior of the fuel sleeve member 76.

The discharge end wall 88 extends in a plane perpendicular to the longitudal axis of the cylindrical housing member 50 and is provided with a plurality of outer nozzle openings 94 and spaced support lugs 96. The nozzle openings 94 have internal threads to receive nozzle members therein as will be explained. The support lugs 96 are provided with interior anchor holes therein so as to receive screw members therein for anchoring the retainer plate and cylinder assembly 44 thereon as will be explained.

The inner fuel nozzle assembly 70 includes a plurality of spaced tube members 98 having an outer threaded nozzle opening 102 to receive an inner nozzle member 104 therein. The tube members 98 are a generally J-shaped with the short leg thereof secured as by welding to the fuel sleeve member 76 and having the outer long leg thereof extended parallel to each other, directed toward the discharge end of the cylindrical housing member 50, and parallel to the longitudinal axis thereof. In this embodiment case, a plurality, namely 15 of the arcute tube members 98 with each having an inner nozzle member 104 therein to the direct the gaseous fluid member is shown but will vary in size and number depending on the particular application of the flame retention burner apparatus 12 of this invention.

The outer fuel nozzle assembly 72 includes the plurality of threaded nozzle openings 94 in the discharge end wall 88 each having a nozzle member 108 mounted therein. A plurality, namely 30, of the nozzle member 108 are illustrated but, as noted above, may vary on application and size of the flame retention burner apparatus 12 being used.

It is seen that the inner fuel nozzle assembly 70 includes the nozzle members 104 placed in a circular pattern and outwardly therefrom is the outer fuel nozzle assembly 72 having the nozzle members 108 mounted in a circular pattern. As will be noted, the use of the plurality of the nozzles with their placement and separation achieves a new and novel combustion function of this invention as will be explained.

The support and air diffuser assembly 66 includes a main circular air diffuser ring 110 which may be secured by welding or the like to the forward portion of the outer periphery of the outer cylindrical wall 84 of the fuel sleeve member 76. The air diffuser ring 110 extends in a plane perpendicular to the longitudinal axis of the cylindrical housing member 50.

More particularly, the air diffuser ring 110 has a main body flange member 112; a plurality of support lugs about an outer edge thereof to secure same to the inner surface of the cylindrical housing member 50; and a plurality of spaced weeper openings 116 in the flange member 112. The weeper openings 116 are a plurality, namely 45, and are generally oblong shaped. The inlet air moves through the weeper openings 116 to provide for further diffusion and agitation of air and fuel particles as will be explained.

The retention plate and cylinder assembly 44 includes (1) an inner fuel director cylinder 120; (2) an inner air director cylinder 122 mounted about the inner fuel director 120; and (3) an outer fuel and air combination director plate 124.

The inner fuel director cylinder 120 is of a plate material in a cylindrical shape having a main director cylinder member 128 with a plurality of spaced outer support lugs 130 connected thereto. The director cylinder member 128 includes an inner wall section 132 having an inner surface 133. The director cylinder member 128 operates to direct a combination of fuel and air particles to a central portion thereof to achieve complete atomization and efficient fuel combustion in a manner to be explained.

The inner air cylinder 122 is mainly a cylindrical air cylinder member 136 which is secured to an outer surface of the support lugs 130 so as to be spaced therefrom and a forward surface is secured to the outer fuel and air combination director plate 124. The air cylinder member 136 is provided with a cylindrical plate wall section 138 and having a plurality of spaced air inlet holes 140 thereabout. The inlet holed 140 allows inlet air to be directed on the outer surface of the director cylinder member 128 so as to cause an airflow in a downward, inward manner on impacting an inner portion of the outer fuel combination director plate 124 as will be explained.

The outer fuel and air combination director plate 124 includes a main director plate 142 having (1) a central deflector section 143; (2) an outer support flange 144 integral with the central deflector section 143; and 3) an inner choke flange 146 integral with an inner edge of the central deflector plate section 143.

The central deflector plate section 143 has a plurality of outer peripheral air holes 148, and an inner plurality of fuel hole member 150, and spaced anchor holes 151.

The plurality of air holes 148, namely 48, are in a circle and operable to the air particles to move forwardly for complete combustion within the cylinder housing 50. The fuel hole members 150 are in a smaller circle and a plurality thereof, namely 36, and are adapated to be aligned and permit the flow of gaseous fuel through the outer nozzle members 108, of the outer fuel nozzle members 72.

The anchor holes 151 are operable to receive threaded bolt members therein for anchoring the entire outer fuel and air combination director plate 124 against the support lugs 96 in the discharge end wall 88.

The outer support flange 144 provides stability to prevent bending of the deflector plate member 142.

The inner choke flange 146 tapers inwardly to form a portion of a cone and operable to direct air moving inside the inner air cylinder 122 towards the center to achieve further mixing and atomization of the fuel and air particles for efficient and effective combustion.

The air and fuel diffuser assembly 46 includes (1) an air diffuser plate 149; (2) an ignition assembly 153 operably connected to a portion of the air diffuser plate 149; and (3) a fuel inlet assembly 154 connected to the air diffuser plate 149 to provide liquid fuel such as fuel oil thereto to the center thereof.

The air diffuser plate 149 includes a conical shaped cone plate member 152 having a plurality of space support members 156 connected thereto. The conical plate member 152 is a plate material forming a portion of a cone and having a central ignition central opening 158, an offset ignitor opening 159, and a plurality of radially spaced fin members 160. The central or inlet opening 158 is adapted to receive a portion of the fuel inlet assembly 154 thereadjacent so as to receive the liquid fuel therein.

The fin members 160 are formed by pressing out a rectangular opening within the conical plate member 152 and a plurality, namely six, are provided. These have an outer tapered section 161 which would act to direct the inlet air in a circular, swirling motion to aid in the complete diffusion and atomization of the fuel and air particles. The ignitor opening 159 is operable to receive the ignition assembly 150 thereon for reasons to be explained.

The spacer support members 156 are welded to the back surface of the conical plate member 152 and are operable to engage the inner wall surface 133 of the inner fuel direction cylinder 120 so that it is rigidly supported during use but can be removed for maintanance and replacement purposes.

The ignition assembly 153 includes a gas ignitor inlet line 162 and having also mounted therewith an electronic ignitor member 164. The gas ignitor inlet line 162 is operable to carry a combustible material such as gas which can be periodically ignited by the fuel control assembly 16 through the electronic ignitor member 164 which is well in the art. The system would be such that the gas ignitor inlet line 162 would only be filled with gas and ignited only as needed to conserve energy.

The fuel inlet assembly 154 includes (1) a fuel inlet pipe member 166; (2) a fuel discharge nozzle 168 mounted on the discharge end of the fuel inlet pipe member 166; and (3) an inlet pipe support bracket 170 operable to support the inlet pipe member 166. The inlet pipe support bracket 170 is connected to a back surface of the conical plate member 152 of the air diffuser plate 149. The inlet pipe support bracket 170 includes a pair of clamp plate members 172 connected by support arms 174 to the back surface of the conical plate member 152. The clamp plate members 172 are operable to clamp the fuel inlet pipe member 166 therebetween so as to place the fuel discharge nozzle 168 at the desirable position within the central opening 158 in the air diffuser plate 149.

The heat exchange assembly 20 as noted in FIG. 1 is provided with a boiler or heater housing 180 having a plurality of heat transfer members 184 therein. The heat transfer members 184 can be hot water tube members or a combustion air flow heat exchange system similar to the heating system on a house. The heat exchanger assembly 20 does not form an integral part of this invention as relates to the new and novel flame retention burner apparatus 12.

The flame retention burner apparatus 12 of this invention can be constructed of various sizes and used with natural or L.P. gas as the proper conditions can be created by the size of the openings in the nozzle members 104, 108 to achieve a proper flow of the gaseous fuel material. This requires a balance between the inner fuel nozzle assembly 70 and the outer fuel nozzle assembly 72 with normally having a ratio of 2 to 1 in number of the nozzle members 104 and 108.

For example, through testing and engineering studies, with the use of natural gas as the fuel, the following conditions create a desirable combustion situation within the flame retention burner apparatus 12 of this invention:

| | |
|---|---|
| Fuel: | Natural Gas |
| Nozzles: (1) | Outer fuel nozzle assembly 72 |
| | Number of nozzle members 108 = 30 |
| | Orifice size (Dia) using |
| | two (2) holes = 0.0980 inches |
| (2) | Inner fuel nozzle assembly 70 |
| | Number of nozzle members 104 = 15 |
| | Orifice size (Dia) using |
| | one (1) hole = 0.1470 inches |

In this example, with 6.0 inches W.C. natural gas pressure, the gas flow in Cubic Feet per Hour=3000.

The orifice size and number of the nozzle members 104, 108 are adjusted with the available gas pressure used in the flame retention burner apparatus 12 to achieve the most efficient and effective diffusion and atomization of the air and fuel particles.

The method or process of this invention involves the steps of supplying air and fuel particles at the proper position and amounts in the flame retention burner apparatus 12 of this invention.

USE OF OPERATION OF THE INVENTION

In the use and operation of the invention, the heat exchange apparatus 10 is illustrated in FIG. 1 as having the flame retention burner apparatus 12 of this invention utilized therein. The inlet air assembly 14 utilizes a blower fan member 24 in order to supply inlet air into the flame retention burner apparatus 12. Of course, the volume and amount of inlet air can be controlled by the speed of rotation of the blower motor 26 and it is acknowledged that the flame retention burner apparatus 12 of this invention can be of various sizes in length and diameter depending on the size of the heat exchange assembly 20 being utilized.

The fuel control assembly 16 is operable through electronic circuits known in the prior art to supply the various needs of fuel oil and/or natural gas, propane, or the like through the respective oil flow assembly 32 and the gas flow assembly 34. The main function of the fuel control assembly 16 is to provide the proper amounts of pressure of the fuel being utilized whether through the oil flow assembly 32 or the gas flow assembly 34. The fuel is calculated and properly metered in order to achieve the complete combustion and maximum efficiency in the flame retention burner apparatus 12.

On operation thereof as noted in FIG. 2 the combustion head assembly 18 can be either operable as gaseous or a liquid fuel operation. In use as a gas operation, it is seen that the gaseous fuel is fed in through the fuel inlet pipe member 78 into the interior of the fuel sleeve member 76. At this point, the gaseous fuel has avenues of outlets through (1) the inner fuel nozzle assembly 70; and (2) the outer fuel nozzle assembly 72. The respective inner nozzle members 104 and outer nozzle members 108 are specifically sized so as to achieve the desirable gaseous fuel flow. It is seen that the inner fuel nozzle assembly 70 with the arcute tube members 98 operate to direct the gaseous material in a circular ring in a forward manner adjacent to an outer periphery of the inner fuel cylinder 120 of the retention plate and cylinder assembly 44.

Additionally, a portion of the gaseous fuel material from within the fuel sleeve member 76 is discharged through the outer fuel nozzle assembly 72 in a circular pattern. This gaseous fuel material thereupon moves through the outer fuel and air combination air director plate 124 to achieve a complete mixing with the inlet air which moves about the air diffuser ring 110 and through the weeper openings 116 to achieve a further diffusion and atomization of the air and fuel particles therein.

Therefore, it is seen on use of the flame retention burner apparatus 12 of this invention with the use of gaseous fuel material, the fuel is mixed in the following manner as noted in FIG. 9.

1. The gaseous fuel material all enters the full sleeve member 76 to be dispensed from the inner fuel nozzle assembly 70 to be mixed with inlet air flow received from:
   (a) centrally of the cylindrical housing member 50 through and about the air diffuser plate 149;
   (b) through the radially spaced fan members 160 to achieve a rotational movement or swirling of this subject air flow; and
   (c) air flow about the inner air cylinder 122 impacts the innter choke flange 146 to be directed to the center of the cylindrical housing member 50;
2. The gaseous fuel material that is dispensed from the outer fuel nozzle assembly 72 is mixed with air flow from:
   (a) through the air holes 148 in the fuel and air combination director plate 124; and (b) adjacent the inner surface of the cylindrical housing member 50 through the weeper openings 116 in the air diffuser ring 110.

On combustion of the diffused air and gaseous fuel material, a central conical flame pattern is noted at 187 and a circular conical flame pattern is noted at 189 in FIG. 9. A further mixing of the combustion gases is achieved by the choke and nozzle assembly 53 with the tapered flange portion 60 by directing the combustion products inwardly.

Next, it is noted that the fuel retention burner apparatus 12 of this invention can be utilized with a liquid fuel such as fuel oil whereupon the fuel inlet pipe member 78 and the nozzle openings 102, 106 may be plugged or left open but the main need is to shut off the entrance of the gaseous fuel material.

On referring to FIG. 10 and the air and fuel diffuser assembly 146, it is seen that the liquid fuel is fed through the fuel inlet pipe member 166 to be discharged in a fine spray through the fuel discharge nozzle 168. It is obvious that the invention can be provided with a plurality, namely 2, 3, or more, of the fuel discharge nozzels 168 depending on the diameter and size of the flame retention burner apparatus 12 of this invention.

The fuel discharge nozzle 168 is provided at the center portion of the conical plate member 152 as operable to spray the fuel particles therein. At this point, it is seen that the inlet air particles are providing substantial turbulence thereof to be mixed with the liquid fuel particles to be ignited in the general area to be indicated at 190. The mixing of the liquid fuel with the inlet air flow is achieved as follows:

1. air moves through the central opening 158 in the conical plate member 152;
2. air flows throught the openings adjacent the fin members 160 to achieve the circular or swirling movement;
3. air flow about the inner air cylinder 122 impacts the inner choke flange 146 to be directed to the center of the cylindrical housing member 50.
4. through the air holes 148 in the fuel and air combination director plate 124; and
5. adjacent the inner surface of the cylinderical housing member 50 through the weeper openings 116 in the air deflector ring 110.

The choke and nozzle assembly 53 is not needed when burning the liquid fuel.

It is seen that the flame retention burner apparatus of this invention can be provided on new or added to existing heat exchange apparatuses such as water boilers, air heaters, or the like. The flame retention burner apparatus is constructed so as to be easily maintained and the air and fuel diffuser assembly can be readily inserted and removed therefrom for replacement and/or maintenance.

The flame retention burner apparatus of this invention is operable for multi-fuel operations; provides a very high efficiency of the burning of the fuel material therein whether in gaseous or liquid form; substantially maintenance free; and easily transferred from liquid to gaseous fuel operation.

While the invention has been described in conjunction with preferred specific embodiments thereof, it will be understood that this invention is intended to illustrate and not to limit the scope of the invention, which is defined by the following claims.

I claim:

1. In a heat exchange apparatus operable to be supplied with a liquid and a gaseous fuel to be mixed with an inlet air supply for combustion and subsequent heat transfer, the improvement being a flame retention burner apparatus, comprising:

(a) a combustion head assembly including a main combustion chamber housing and an inlet fuel and air diffuser assembly mounted within said main combustion chamber housing and connected to the gaseous fuel supply;

(b) said inlet fuel and air diffuser assembly includes an inlet fuel diffuser assembly having an inner fuel nozzle assembly and an outer fuel nozzle assembly, each having a concentric ring of forwardly projected nozzle members to direct and supply the gaseous fuel axially of said main combustion chamber housing;

(c) said inlet fuel and air diffuser assembly includes a support and air diffuser assembly mounted about said inlet fuel diffuser assembly;

(d) said support and air diffuser assembly includes an air diffuser ring having a plurality of openings to receive and agitate the inlet air supply moving therethrough; and (e) an inlet air supply is connected to one end of said main combustion chamber housing with inlet air directed and flowing in the center and about the outer periphery of said inlet fuel and air diffuser assembly to mix with the gaseous fuel prior to combustion for maximum atomization of particles and efficiency in combustion.

2. A heat exchange apparatus operable to be supplied with a liquid and a gaseous fuel to be mixed with an inlet air supply for combustion and subsequent heat transfer, the improvement being a flame retention burner apparatus, comprising:

(a) a combustion head assembly including a main combustion chamber housing and an inlet fuel and air diffuser assembly mounted within said main combustion chamber housing and connected to the gaseous fuel supply;

(b) said inlet fuel and air diffuser assembly having an inner fuel nozzle assembly and an outer fuel nozzle assembly, each having a concentric ring of forwardly projected nozzle members to direct and supply the gaseous fuel axially of said main combustion chamber housing;

(c) said inlet fuel and air diffuser assembly includes a cylindrical fuel chamber and a support and air diffuser assembly mounted about an outer periphery of said fuel chamber and between said main combustion chamber housing; and (d) said support and air diffuser assembly housing having an air diffuser ring with a plurality of weeper openings to direct the outer air flow to mix with the gaseous fuel from said outer fuel nozzle assembly;

whereby the inlet air supply is directed and flows in the center and about the outer periphery of said inlet fuel and air diffuser assembly to mix with the gaseous fuel prior to combustion for maximum atomization of particles and efficiency in combustion.

3. A flame retention. burner apparatus as described in claim 2, including:

(a) a retention plate and cylinder assembly mounted within said inlet fuel and air diffuser assembly having an inner fuel director cylinder mounted about said inner fuel nozzle assembly;

whereby said inner fuel director cylinder directs a portion of the inlet air supply centrally of said main combustion chamber housing to mix with the gaseous fuel from said inner fuel nozzle assembly.

4. A flame retention burner apparatus as described in claim 3, wherein:

(a) said retainer plate and cylinder assembly includes an inner air director cylinder mounted about said inner fuel director cylinder;

whereby said inner air director cylinder directs a portion of the inlet air supply forwardly and centrally of said fuel nozzle assembly to create turbulence and mixing of the gaseous fuel and the inlet air supply.

5. A flame retention burner apparatus as described in claim 4, wherein:

(a) said retention plate and cylinder assembly includes an outer fuel and air director plate secured to said inner air director cylinder and forwardly of said outer fuel nozzle assembly; and (b) said outer fuel and air director plate includes an inner choke flange to direct a portion of the inlet air supply from said inner air director cylinder towards a longitudinal axis of said main combustion cylinder housing to mix with the gaseous fluid from said inner fuel nozzle assembly.

6. A flame retention burner apparatus as described in claim 5, wherein:

(a) said outer fuel and air combustion director plate member having a plurality of air holes and fuel holes; and (b) said air holes having individual ones that are aligned with respective ones of said nozzle members in said outer fuel nozzle assembly;

whereby the gaseous fuel from said outer fuel nozzle assembly mixes with the inlet air supply from said outer fuel and air combustion director plate member.

7. A heat exchange apparatus operable to be supplied with a liquid and a gaseous fuel to be mixed with an inlet air supply for combustion and subsequent heat transfer, the improvement being a flame retention burner apparatus, comprising:

(a) a combustion head assembly including a main combustion chamber housing and an inlet fuel and air diffuser assembly mounted within said main combustion chamber housing and connected to the gaseous fuel supply;

(b) said inlet fuel and air diffuser assembly having an inner fuel nozzle assembly and an outer fuel nozzle assembly, each having a concentric ring of forwardly projected nozzle members to direct and supply the gaseous fuel axially of said main combustion chamber housing;

(c) an air and fuel diffuser assembly mounted within said inlet fuel and air diffuser assembly;

(d) said air and fuel diffuser assembly includes an air diffuser plate extended transversely of a longitudinal axis of said main combustion chamber housing and a fuel inlet assembly mounted centrally of said air diffuser plate; and (e) said fuel inlet assembly having a fuel inlet pipe member and a fuel discharge nozzle secured to an outer end of said fuel inlet pipe member;

whereby the liquid fuel is supplied to said fuel inlet pipe member to be sprayed in a mist through said fuel discharge nozzle in the center of said air diffuser plate to achieve atomization and complete combustion of the inlet supply of air and liquid fuel mixture.

8. A flame retention burner apparatus as described in claim 7, wherein:

(a) said air diffuser plate being a conical plate member with a plurality of air openings with fin members to direct a part of the inlet air supply tangentially and inwardly to agitate the inlet air supply and liquid fuel mixture to achieve complete combustion and maximum efficiency.

9. A flame retention burner apparatus as described in claim 7, wherein:

(a) said fuel inlet assembly having a plurality of fuel discharge nozzls connected to said fuel inlet pipe member to achieve a desired atomization and pattern of the liquid fuel mist to be sprayed into the center portion of said main combustion chamber housing for efficiency in combustion thereof.

10. A heat exchange apparatus operable to be supplied with a liquid and a gaseous fuel to be mixed with an inlet air supply for combustion and subsequent heat transfer, the improvement being a flame retention burner apparatus, comprising:

(a) a combustion head assembly including a main combustion chamber housing, an inlet fuel and air diffuser assembly mounted within said main combustion housing assembly, and an air and fuel diffuser assembly mounted centrally of said inlet fuel and air diffuser assembly;

(b) an inlet air supply connected to one end of said main combustion chamber to provide inlet combustion air;

(c) said inlet fuel and air diffuser assembly having an inner fuel nozzle assembly and an outer fuel nozzle assembly operable to direct said inlet air supply and said inlet fuel centrally thereof and about an outer periphery;

(d) said air and fuel diffuser assembly includes an air diffuser plate mounted centrally of said main combustion chamber housing; an ignition assembly connected to said air diffuser plate; and a fuel inlet assembly mounted centrally of said air diffuser plate; and (e) said fuel inlet assembly having a fuel inlet supply line with a fuel discharge nozzle on the outer end thereof;

whereby the liquid fuel is supplied to said fuel inlet pipe member to be sprayed in a mist through said fuel discharge nozzle centrally of said main combustion chamber housing to be mixed with the inlet supply air both from an outer periphery and centrally of said inlet fuel and air diffuser assembly to achieve the maximum atomization and subsequent combustion of the air-fuel mixture.

11. A flame retention burner apparatus as described in claim 10, wherein:

(a) said combustion head assembly includes a retention plate and cylinder assembly mounted within said inlet fuel and air diffuser assembly; and (b) said retention plate and cylinder assembly includes an inner air cylinder having a air cylinder member operable to direct a portion of the inlet air supply circumferentially towards a longitudinal axis of said main combustion chamber assembly and mix with the liquid fuel from said fuel discharge nozzle to achieve atomization and diffusion of the fuel and air particles.

12. A method of achieving high efficiency and complete combustion of either an inlet air supply and a gaseous fuel mixture or an inlet air supply and a liquid fuel mixture within a flame retention burner apparatus, comprising the following steps:

(a) supply the inlet air supply to an inlet end of said flame retention burner apparatus having a main combustion chamber housing with an inlet fuel and air diffuser assembly mounted in said main combustion chamber housing and said inlet fuel and air diffuser assembly includes a support and air duffuser assembly mounted about an inlet fuel diffuser assembly;

(b) supplying a gaseous fuel to said inlet fuel diffuser assembly for discharge through a concentric circle of an inner fuel nozzle assembly and an outer fuel nozzle assembly; and (c) directing a portion of the inlet air supply about an outer periphery of said inlet fuel diffuser assembly to said support and air diffuser assembly to cause a mixing thereof with the gaseous fuel supply through said outer fuel nozzle assembly to achieve maximum combustion and efficiency thereof.

13. A method of achieving combustion of a fuel and air mixture as described in claim 12, including:

(a) supplying a portion of the air inlet supply between said concentric circles of said inner fuel nozzle assembly and said outer fuel nozzle assembly and having the same directed downstream thereof inwardly towards a longitudinal axis of said main combustion chamber housing to be mixed with the gaseous fuel discharged from said inner fuel nozzle assemblies to achieve maximum agitation and atomization of the inlet air supply and gaseous fuel mixture.

14. A method of achieving combustion as described in claim 13, wherein:

(a) ceasing the supply of the gaseous fuel to said inlet fuel and air diffuser assembly; and (b) supplying a liquid fuel material centrally of said inner fuel nozzle assemblies in a fine mist so as to be mixed with the inlet air centrally thereof and about an outer periphery of said inner fuel nozzle assembly to achieve a combustion of the inlet air supply and the liquid fuel supply;

whereby said inlet air supply and said fuel retention burner apparatus is readily converted for use from a liquid fuel supply or a gaseous fuel supply so as to be operable in either mode and readily converted from one to the other.

* * * * *